US006506082B1

(12) United States Patent
Meek et al.

(10) Patent No.: US 6,506,082 B1
(45) Date of Patent: Jan. 14, 2003

(54) ELECTRICAL CONTACT INTERFACE

(75) Inventors: Ron Meek, Shawnee, KS (US); William E. Thurston, Kansas City, MO (US)

(73) Assignee: Interconnect Devices, Inc., Kansas City, KS (US)

( * ) Notice: Subject to any disclaimer, the term of this patent is extended or adjusted under 35 U.S.C. 154(b) by 0 days.

(21) Appl. No.: 10/028,202

(22) Filed: Dec. 21, 2001

(51) Int. Cl.[7] ..... H01R 13/24
(52) U.S. Cl. ..... 439/700
(58) Field of Search ..... 439/700, 824, 439/66

(56) References Cited

U.S. PATENT DOCUMENTS 4,636,026 A * 1/1987 Cooney et al. ..... 439/824

5,967,856 A * 10/1999 Meller ..... 439/700

* cited by examiner

*Primary Examiner*—Gary Paumen
(74) *Attorney, Agent, or Firm*—Wm. Bruce Day

(57) ABSTRACT

An electrical contact interface consists of a probe formed by a pair of oppositely extending plungers each having a contact tip, an inner shoulder and a rearwardly extending shaft terminating in a lug end. A coil spring is sleeved about the opposed plungers and is positioned between the opposite inner shoulders with the shafts extending toward each other and in constant sliding engagement with each other through the lug ends. The lug ends abut each other at an extreme travel relation of the plungers and prevent mutual disengagement of the plungers from within the coil spring. The probe is mounted in a fixture or other intermediate structure for positioning between circuit contacts. The probe finds particular use in applications requiring robust design and in which electrical contact must be maintained.

9 Claims, 1 Drawing Sheet

ELECTRICAL CONTACT INTERFACE

FIELD OF THE INVENTION

This invention relates to spring contact probes in general and particularly to such probes that are used in fixture interfaces for use in applications requiring particularly robust design.

BACKGROUND OF THE INVENTION

Spring probes for electrical interfaces are well known in the prior art and represent a wide family of technology for providing interconnection between electrical contact points. Some spring probes are designed for circuit testing and are suited for placing in a matrix providing an interface between a testing circuit computer and a device under test, which is ordinarily an integrated chip or a circuit board. While some circuit boards are loaded with components and then tested when completed, a preferred method of manufacture is to test circuit boards and if passed, then stuff the board with the necessary components to create the full circuit, as this procedure is much more cost effective if the circuit board is defective. Other spring probes are used in interfaces when components may be removed and replaced, as necessary for maintenance or control unit upgrades.

A major criterion for spring probes is that they provide the shortest possible circuit path between test sites in order to minimize resistance losses. Yet another criterion for spring probes which are used in harsh environments is that they be designed for robustness. Vehicles and weapons guidance and control systems use electrical circuits in which key components are removed and replaced, often for testing purposes or for upgrades. These units are commonly subjected to extreme heat, pressure, g-forces and vibrations and must maintain electrical contacts between components for functionality.

SUMMARY OF THE INVENTION

An electrical contact interface includes a spring probe which fits into intermediate structure for positioning between circuit contacts. The spring probe consists of a pair of oppositely extending plungers with each plunger including a head end having a contact tip, an inner shoulder and a rearwardly extending shaft terminating in a lug end. A coil spring is sleeved about the plungers and positioned between the opposite inner shoulders with the shafts extending toward each other and in constant sliding engagement with each other through the lug ends. The lug ends slide back and forth as the shafts mutually reciprocate and abut each other at an extreme travel relation of the plungers to prevent mutual disengagement of the plungers from within the coil spring. The coil spring and opposed plungers form a unit which is placed within the intermediate interconnect structure, such as within a bore extending between opposite side surfaces of an interconnect fixture.

OBJECTS OF THE INVENTION

The objects of the present invention are:

a) to provide an electrical contact spring probe which fits into an intermediate structure for positioning between circuit contacts;

b) to provide such a spring probe which is double ended to provide resilient contact tips on opposite ends;

c) to provide such a spring probe which is particularly robust in construction;

d) to provide such a spring probe which provides an electrical circuit path of minimal length to minimize resistance; and e) to provide such a spring probe and interface device which is particularly well adapted for the intended purpose and is economical of construction.

Other objects and advantages of the present invention will become apparent from the following description taken in connection with the drawings which provide an exemplary embodiment of the present invention.

DESCRIPTION OF THE PREFERRED AND ALTERNATE EMBODIMENTS

As required, detailed descriptions of the preferred and alternate embodiments are disclosed herein, however, it is to be understood that the disclosed embodiments are merely exemplary of the invention which may be embodied in various forms. Therefore, specific structural and functional details herein are not to be interpreted as limiting, but merely as a basis for the claims and as a representative basis for teaching one skilled in the art to variously employ the present invention in virtually any appropriately detailed structure.

Figure 1:
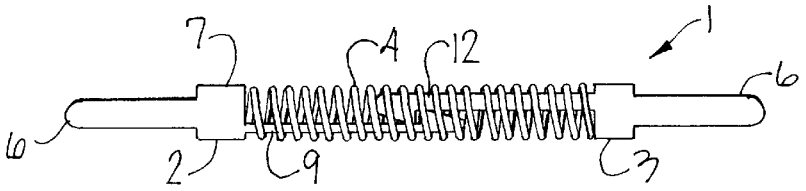
FIG. 1 is a elevational view of a spring contact interconnect embodying the present invention.

The reference numeral 1, FIG. 1 generally indicates a spring contact interconnect probe embodying the present invention. The probe 1 generally consists of a pair of oppositely extending plungers 2 and 3 which are connected together as hereinafter described and biased to an outwardly extended relative position by a biasing means 4. In further detail, each of the plungers 2 and 3 has an outer end terminating in a contact tip 6 which engages an electrical site (not shown) to complete an electrical path between aligned sites. The contact tip 6 may be in various forms as is well known in the electrical spring contact probe art, including star forms, crown forms, cup forms, chisel forms, points and rounded tips, such as shown in the drawings hereof. Selection of the form of contact tip is a matter of designer's choice, taking into account the nature of the contact site and the environment of use. Rearwardly of the contact tip 6, or moving toward the center of the probe 1, the contact tip extends from a radially extended shoulder 7 which at its inner edge provides a surface which bears against the end of the spring comprising the biasing means 4. In the illustrated example, the contact tip 6 and shoulder 7 are generally rectangular in cross-section although other cross-sectional forms could be employed such as circular or oval. The cross-sectional form is a matter of designer's choice. These components ride within a bore within the intermediate structure as hereinafter described. Rearwardly of the shoulder 7, the plunger 2 or 3 extends in a shaft 9 which preferably has a flat contact surface 10 and is square or rectangular in section. The shaft 9 terminates at its inward end in a lug end 12 which at its remote end is formed into a blunt tip 14 with a ramp area 15 joining a sliding flat 16. The sliding flat 16 terminates toward the shoulder 7 in an inner shoulder which serves as a catch 18 which then joins with the contact surface 10 of the shaft 9. The shaft 9 in its entirety is off-set from the longitudinal center line of the plunger 2 or 3 with the sliding flat 16 of the lug end 12 extending to the radius center. The preferred material of manufacture is a BeCu alloy, although other materials of high conductively and sufficient strength may be used as desired.

Figure 2:
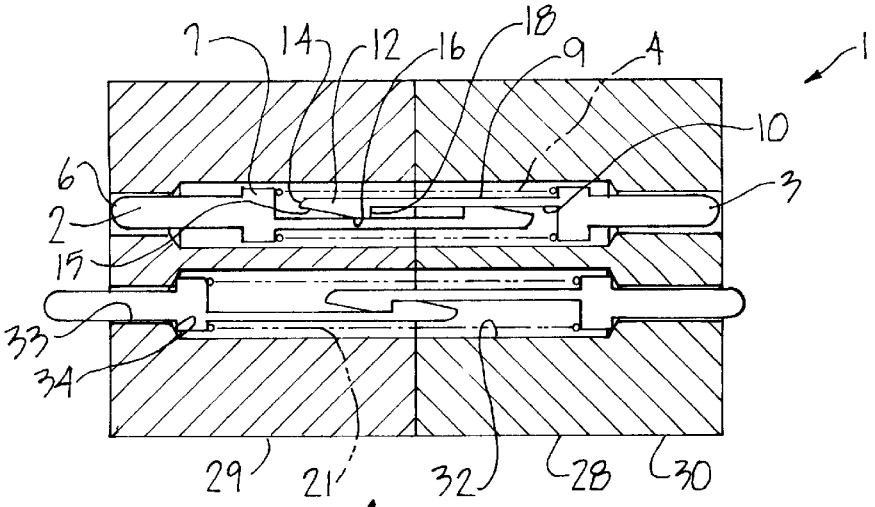
FIG. 2 is a sectional view of the spring contact probe mounted in an intermediate structure.
Figure 3:
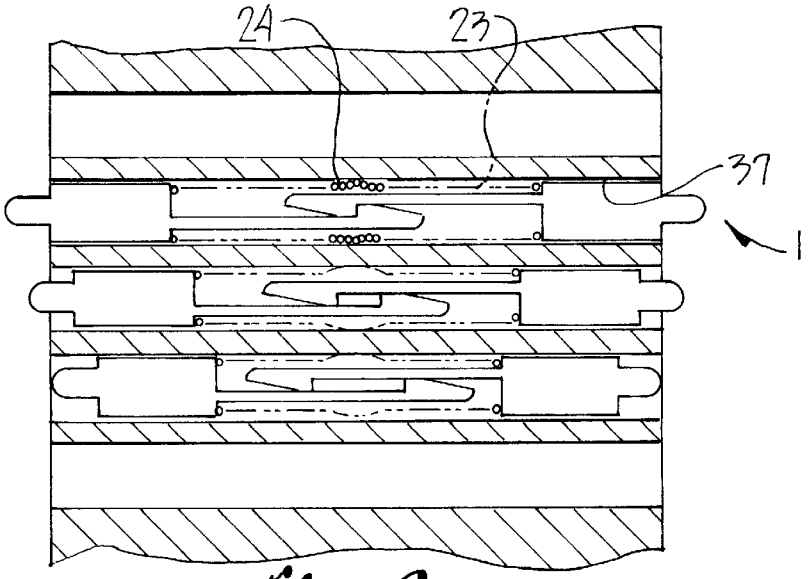
FIG. 3 is a fragmentary view of an alternative embodiment of spring contact probe mounted in an intermediate structure.

The opposed plungers 2 and 3 are positioned as shown in FIGS. 2 and 3 so that they extend in opposite directions and the shafts 9 are rotated 180 degrees from each other. In that relation, the lug end sliding flats 16 are each in continuous sliding contact with the shaft contact surface 10 of the other plunger. The inner shoulder catches 18 engage each other at the farthest point of outward travel of the plungers 2 and 3, FIG. 2 and provide an outer limit of travel. An inner limit of travel is provided either by the respective blunt tips 14 contacting the shoulder 7 of the opposite plunger 2 or 3 or by full compression of the biasing means 4.

In the illustrated example, the biasing means 4 is a coil spring which extends between the opposite plunger shoulders 7 and provides a sleeve surrounding the joined shafts 9. As shown in FIG. 2, the biasing means 4 is a constant diameter coil spring 21. Other forms of biasing means may be used as appropriate. Such other forms of biasing means include well known substitutes and equivalents such as sleeves of resilient polymeric materials and other spring forms. One form of coil spring is shown in FIG. 2. An alternative form of coil spring is shown in connection with FIG. 3 wherein the spring contact interconnect probe 1 is alike in all respects to that described above with the exception that a coil spring 23 is utilized which has a radially expanded center section 24 which provides an interference fit in a straight bore as hereinafter described.

Preferably, the spring contact interconnect probe 1 is assembled and provided as a unit by positioning a coil spring, such as the coil springs 21 or 23 or other biasing means 4 about the shaft 9 of one of the plungers 2 or 3, then the other plunger is inserted into the biasing means 4 by its shaft 9 so that the two lug ends 12 slide over each other by the blunt tip 14 and the ramp area 15 until the opposite inner shoulder catches 18 snap downwardly, engage and prevent the plungers 2 and 3 from separation.

The probe 1 is intended for use in an intermediate structure such as a split fixture 28, FIG. 2. A split fixture 28 would carry a multiplicity of spring contact interconnect probes 1 and be situated between electrical contact sites (not shown). The split fixture 28, in a typical example, has halves 29 and 39 arranged in layered fashion and with a coaxial bore 32 extending between and through the halves 29 and 30. At outer surfaces of each of the halves 29 and 30, the bore 32 enters a smaller diameter bore 33 with a sloped shoulder 34 separating the smaller bore 33 from the larger bore 32. As shown in FIG. 2, the plunger 1 is trapped within the bore 32 with the probe shoulder 7 contacting the bore shoulder 34 to maintain the probe 1 trapped within the bore 32. The halves 29 and 30 are of course separable to allow installation and removal and replacement as necessary of the probes 1.

A different type of intermediate structure is shown in connection with FIG. 3 wherein a fixture 36 is a solid block and a bore 37 of uniform diameter extends therethrough. To secure the probe 1 within this type of bore, the FIG. 3 embodiment uses its expanded center section 24 of the coil spring 32 which frictionally engages the bore walls.

Other types of means of securement may be used as selected to secure the spring contact interconnect probe within any appropriate intermediate structure.

It is to be understood that while certain forms of the present invention have been illustrated and described herein, it is not to be limited to those specific forms or arrangement of parts described and shown except insofar as limited as the following claims.

What is claimed and desired to be protected by Letters Patent is:

1. An electrical contact interface comprising:

a) intermediate structure for positioning between circuit contacts, said structure having opposite surfaces and a bore therethrough;

b) a pair of oppositely extending plungers situated in said bore, with each said plunger including a head end received in said bore with a contact tip protruding outwardly thereof and a shaft extending rearwardly from said head end and terminating in a lug end, said pair of plungers opposed to each other with said contact tips protruding from opposite open ends of said bore and with said shafts opposed and slidably interconnected by complementary said lug ends; and c) means for biasing said plungers to an outwardly extended position, said means being received in said bore.

2. The electrical contact interface set forth in claim 1 wherein said means for biasing is a spring.

3. The electrical contact interface set forth in claim 2 wherein said means for biasing is a coil spring sleeved about said shafts.

4. The electrical contact interface set forth in claim 1 wherein said intermediate structure is a fixture having at least two parts through which said bore extends as a primary bore and having secondary bores of smaller diameter than said primary bore opening to said opposite surfaces so that said plunger contact tips extend through said secondary bores and with the remainder of said plungers trapped in said primary bore.

5. An electrical contact interface comprising;

a) a fixture having opposite surfaces and a bore therethrough;

b) a pair of oppositely extending plungers situated in said bore, each said plunger including a head end received in said bore with a contact tip protruding outwardly thereof and a shaft extending rearwardly from said head end and terminating in a lug end, said pair of plungers opposed to each other with said contact tips protruding from opposite open ends of said bore and with said shafts opposed and slidably interconnected by complementary said lug ends; and c) a coil spring received within said barrel and around said shafts so as to urge said plunger heads oppositely outward to an extended position.

6. An electrical contact interface comprising;

a) means forming a tubular barrel having opposite open ends;

b) a pair of oppositely extending plungers situated in said barrel, each said plunger including a head end received in said barrel with a contact tip protruding through said barrel open end, and a shaft extending rearwardly from said head end and terminating in a lug end, said pair of plungers opposed to each other with said contact tips protruding from opposite open ends of said barrel and with said shafts opposed and slidably interconnected by complementary said lug ends; and c) a coil spring received within said barrel and around said shafts so as to urge said plunger head ends oppositely outwardly to an extended position.

7. An electrical contact interface comprising:

a) intermediate structure for positioning between circuit contacts, said structure having opposite surfaces and a bore therethrough;

b) a pair of oppositely extending plungers situated in said bore, with each said plunger including a head end and received in said bore with a contact tip protruding outwardly thereof and a shaft extending rearwardly from said head end and terminating in a lug end, said pair of plungers opposed to each other with said contact tips protruding from opposite ends of said bore and with said shafts opposed and slidably interconnected by complementary said lug ends; and c) a coil spring sleeved about said plungers and biasing said plungers to mutually outwardly extending positions, said coil spring having a radially enlarged generally center section having an interference fit with an inner wall of said bore for maintaining said plungers therein.

8. An electrical contact interface comprising:

a) a pair of oppositely extending plungers each having a contact tip, an inner shoulder and a rearwardly extending shaft terminating in a lug end; and b) a coil spring sleeved about said plungers and positioned between opposite said inner shoulders, with said shafts extending toward each other and in constant sliding engagement with each other through said lug ends, said lug ends abutting each other at an extreme travel relation of said plungers and preventing mutual disengagement of said plungers from within said coil spring.

9. The electrical contact interface set forth in claim 8 wherein said coil spring has a generally medially situated radially extending bulge for interference fit engagement within a mounting fixture.

* * * * *